US009975361B2

(12) United States Patent
Okamura

(10) Patent No.: US 9,975,361 B2
(45) Date of Patent: May 22, 2018

(54) IMAGE FORMATION APPARATUS

(71) Applicant: Shinka Information System Co., Ltd., Tokyo (JP)

(72) Inventor: Atsushi Okamura, Tokyo (JP)

(73) Assignee: SINKA Corporation, Tokyo (JP)

( * ) Notice: Subject to any disclaimer, the term of this patent is extended or adjusted under 35 U.S.C. 154(b) by 0 days. days.

(21) Appl. No.: 15/728,811

(22) Filed: Oct. 10, 2017

(65) Prior Publication Data

US 2018/0104968 A1 Apr. 19, 2018

(30) Foreign Application Priority Data

Oct. 14, 2016 (JP) ..... 2016-203022

(51) Int. Cl.

| | |
|---|---|
| ***B41J 15/16*** | (2006.01) |
| ***B41J 3/38*** | (2006.01) |
| ***B41J 11/00*** | (2006.01) |
| ***B41J 3/32*** | (2006.01) |
| ***B41J 2/32*** | (2006.01) |

(52) U.S. Cl.

CPC ..... *B41J 15/165* (2013.01); *B41J 2/32* (2013.01); *B41J 3/32* (2013.01); *B41J 3/38* (2013.01); *B41J 11/004* (2013.01)

(58) Field of Classification Search

CPC ..... B41J 3/32; B41J 11/004; B41J 2/315

See application file for complete search history.

(56) References Cited

U.S. PATENT DOCUMENTS 5,072,245 A * 12/1991 Tamura ..... G03F 7/0022 250/318
5,636,927 A * 6/1997 Fox ..... B41J 2/32 347/218
5,677,049 A 10/1997 Torii (Continued)

FOREIGN PATENT DOCUMENTS

CN 101665032 A 3/2010
CN 104417054 A 3/2015

(Continued)

OTHER PUBLICATIONS

Notification of Reasons for Refusal dated Jan. 16, 2017, issued in counterpart Japanese application No. 2016-203022, with English translation (9 pages).

(Continued)

*Primary Examiner* — Shelby Fidler
(74) *Attorney, Agent, or Firm* — Westerman, Hattori, Daniels & Adrian, LLP

(57) ABSTRACT

A thermal printer according to this embodiment forms a stereoscopic image by applying heat to a printing medium having a surface evenly coated with foaming capsules which foam when heated. More specifically, the thermal printer includes a conveyance guide which is formed into a convex shape whose apex is an image formation position where heat is applied to the printing medium, and regulates the position of the conveyed printing medium, and a thermal head assembly which is installed such that a thermal head distal end portion contacts with the printing medium conveyed by the conveyance roller from below the image formation position, and forms a stereoscopic image by applying heat to the printing medium.

10 Claims, 8 Drawing Sheets

(56) References Cited

U.S. PATENT DOCUMENTS

| | | | | |
|---|---|---|---|---|
| 6,004,419 | A | 12/1999 | Torii | |
| 8,106,932 | B2 | 1/2012 | Yoshimura | |
| 9,162,486 | B2 | 10/2015 | Motoyanagi | |
| 2004/0189783 | A1 | 9/2004 | Mogi | |
| 2015/0165794 | A1* | 6/2015 | Zhang | B41J 11/70 225/46 |
| 2016/0167394 | A1* | 6/2016 | Phoenix | B41J 2/325 347/194 |

FOREIGN PATENT DOCUMENTS

| | | | | | |
|---|---|---|---|---|---|
| JP | 61-120770 | A | | 6/1986 | |
| JP | 63-280663 | A | | 11/1988 | |
| JP | 7-125266 | A | | 5/1995 | |
| JP | 8-108553 | A | | 4/1996 | |
| JP | 8-175029 | A | | 7/1996 | |
| JP | 8-244286 | A | | 9/1996 | |
| JP | 11-91244 | A | | 4/1999 | |
| JP | 11-235848 | A | | 8/1999 | |
| JP | 3775613 | B2 | | 5/2006 | |
| JP | 2006-150673 | A | | 6/2006 | |
| JP | 2007168280 | A | * | 7/2007 | B41J 11/007 |
| JP | 2016-124238 | A | | 7/2016 | |
| WO | 2016/021477 | A1 | | 2/2016 | |

OTHER PUBLICATIONS

Decision to Grant a Patent dated Mar. 31, 2017, issued in counterpart Japanese application No. 2016-203022, with English translation (5 pages).

Extended European Search Report dated Feb. 20, 2018, issued in counterpart European Application No. 17196149.3. (8 pages).

Office Action dated Feb. 14, 2018, issued in counterpart Taiwanese Application No. 106133993, with English translation (8 pages).

* cited by examiner

IMAGE FORMATION APPARATUS

BACKGROUND OF THE INVENTION

Field of the Invention

The present invention relates to an image formation apparatus for forming a stereoscopic image by using a thermal head.

Description of the Related Art

In the field of forming Braille and tactile graphics for visually impaired persons, a Braille printer which mechanically prints out projections on paper is used. However, a drawing for tactile graphics represents straight lines and curved lines by the continuation of dots, and hence cannot draw intended straight lines and curved lines. Also, since the printer is mechanical, the apparatus size is large, and the operation noise is large. In addition, the printer is not widely used for the purpose of personal use because it is expensive.

Japanese Patent No. 3775613 has disclosed a method of forming a three-dimensional image by using a thermal printer and a printing sheet made of a thermoexpandable or thermoshrinkable material. In this method, a grayscale or color two-dimensional image is printed on the printing sheet by the thermal head by using a printing ribbon. Then, a cover ribbon is interposed between the thermal head and the printed printing sheet made of a thermoexpandable or thermoshrinkable material, and projections and recesses are formed on the grayscale or color image by heating the image from above the cover ribbon. More specifically, projections and recesses are formed in arbitrary portions of the grayscale or color image by performing the heating process again in conventional thermally printed portions by using the thermal head.

Japanese Patent Laid-Open No. 7-125266 has disclosed a thermal printing apparatus which contacts a thermal head with the lower surface of a thermally foamable printing medium, and applies the heat of the thermal head, thereby easily forming projections on the printing medium. This thermal printing apparatus has a structure which does not interfere with the expansion of the printing medium by using a platen having recessed grooves or linear grooves when pushing the printing medium against the thermal head.

Also, a stereoscopic copying system which uses capsule paper coated with a thermally foamable material as a printing medium. In this system, portions to be made stereoscopic are printed by black toner by a copying machine, and the surface of the capsule paper is irradiated with high heat by a stereoscopic formation machine as another apparatus by using halogen light or the like. Since the heat is particularly concentrated to the black toner portions, these black portions are foamed, and a stereoscopic image is formed.

Unfortunately, the abovementioned related arts pose the following problems. For example, in the arrangement of Japanese Patent Laid-Open No. 7-125266, the shape of the recess or line restricts a portion where a projection is to be famed by expansion. Therefore, a stereoscopic shape having a fixed interval such as Braille can be formed, but it is impossible to draw a given continuous straight line or curved line such as a horizontal line, oblique line, or curve. In addition, the abovementioned copying system has the advantage that the system can easily form a plurality of copies of the same stereoscopic image, but the apparatus is large and expensive. Also, since heat is applied to the entire surface of the printing medium, a foaming phenomenon may occur in not a few portions other than foaming portions, and this makes minute images difficult to form. Furthermore, the surfacemost layer of a foaming portion receives highest heat, the surfacemost portion of foaming easily becomes fragile and is easily scraped off.

As described above, practical apparatuses for forming Braille and tactile graphics stereoscopic materials for visually impaired persons are classified into the mechanical Braille printer and the combination of the copying machine and stereoscopic formation machine using capsule paper, but any of these apparatuses is large and expensive. Therefore, these apparatuses are used in the formation of materials in enterprises, parties, Braille translation volunteer groups, and schools, but are not widely owned and used by individuals. Also, the figure drawing function of the mechanical Braille printer draws a stereoscopic figure by the continuation of dots, and the dot size is fixed. This imposes restrictions on the expression of stereoscopic images. In addition, when the stereoscopic copying machines form a stereoscopic image, minute drawing of a thin line or the like is limited. On the other hand, visually impaired people are beginning to more and more use personal computers, and are demanding an image formation apparatus capable of easily forming Braille and arbitrary solid figures at home. This invention provides a stereoscopic image formation thermal printer apparatus using a thermal head, which can be used by visually impaired persons themselves.

SUMMARY OF THE INVENTION

The present invention provides a small-sized, low-noise, and inexpensive image formation apparatus capable of forming a stereoscopic image of an arbitrary continuous straight line or curved line by using a thermal head.

One aspect of the present invention provides an image formation apparatus for forming a stereoscopic image by applying heat to a printing medium having a surface evenly coated with foaming capsules which foam when heated, comprising: a plurality of conveyance rollers that feed the printing medium into the apparatus and convey the printing medium; a conveyance guide that is formed into a convex shape whose apex is an image formation position where heat is applied to the printing medium, and regulates a position of the conveyed printing medium; a thermal head that is installed such that a distal end portion contacts with a printing medium conveyed by the plurality of conveyance rollers from below the image formation position, and forms a stereoscopic image by applying heat to the printing medium; and a tension unit that is positioned on an upstream side of the image formation position in a conveying direction of a printing medium, and pushes the conveyed printing medium toward the distal end portion of the thermal head by giving tension to the printing medium.

DESCRIPTION OF THE EMBODIMENTS

Embodiments of the present invention will be explained in detail below with reference to the accompanying drawings. Note that the following embodiments do not limit the present invention according to the scope of claims, and not all combinations of features explained in the embodiments are essential to the means of solution of the present invention.

First Embodiment

<Arrangement of Image Formation Apparatus>

Figure 1:
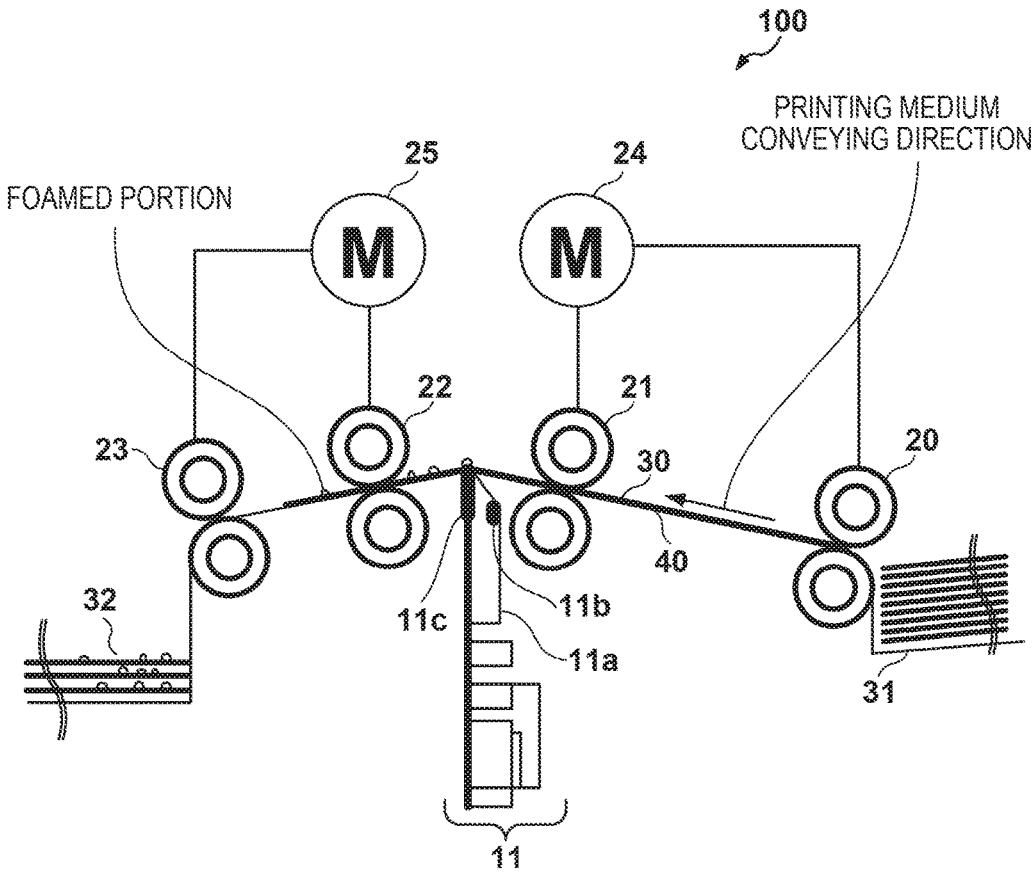
FIG. 1 is a view showing an arrangement example of an image formation apparatus according to an embodiment.

The first embodiment of the present invention will be explained below. First, an arrangement example of an image formation apparatus according to this embodiment will be explained with reference to FIG. 1. In this embodiment, an image formation apparatus applicable to the present invention will be explained by taking a thermal printer for forming a stereoscopic image as an example.

A thermal printer 100 mainly includes a thermal head assembly 11, a feed roller 20, a tension roller 21, a conveyance roller 22, a discharge roller 23, driving motors 24 and 25, a printing medium cassette 31, a discharge tray 32, and a conveyance guide 40. The thermal head assembly 11 applies heat to a foaming layer of a conveyed printing medium from the lower surface of the medium, thereby foaming a stereoscopic image such as an arbitrary straight line or curved line on the printing medium. The thermal head assembly 11 includes a heater block 11*a* for heat radiation, a temperature sensor lib, and a thermal head distal end portion 11*c*.

The feed roller 20 is a roller for feeding printing media one by one into the apparatus from the printing medium cassette 31. The tension roller (tension unit) 21 is a roller for conveying a printing medium to the conveyance roller 22, and applying tension to the printing medium after that. Details of the operation of the tension roller 21 when applying tension will be described later. The conveyance roller 22 is a roller for conveying the printing medium at a constant velocity when printing is performed. The discharge roller 23 is a roller for discharging the conveyed printing medium outside. The driving motor 24 is a motor for giving torque to the feed roller 20 and tension roller 21. The driving motor 25 is a motor for giving torque to the conveyance roller 22 and discharge roller 23.

A printing medium 30 is a double-layered printing medium having a surface coated with foaming capsules. The printing medium cassette 31 is a cassette for stacking a plurality of printing media. The discharge tray 32 is a tray for stacking discharged printing media 30 on which stereoscopic images are famed. The conveyance guide (conveyance path) 40 is a guide arranged in a portion between rollers where the printing medium 30 passes, and regulates the position of the conveyed printing medium 30.

In the position where the thermal head assembly 11 is installed, the thermal printer 100 according to this embodiment does not have a platen roller which is used in an ordinary thermal printer or the like. The platen roller is a roller for pushing the conveyed printing medium 30 toward the thermal head assembly 11 from above. As explained in the abovementioned related art, this platen roller has recesses or lines in order to form the space of foaming which occurs when heat is applied to the printing medium 30, but this space limits the expansion of a foamed portion. Accordingly, the arrangement of this embodiment has no platen roller in order to form a stereoscopic image such as an arbitrary straight line or curved line without any restrictions as described above. Since no platen roller pushes the printing medium 30, therefore, the thermal printer 100 according to this embodiment requires an alternative arrangement for pushing the printing medium 30 against the thermal head assembly 11. In this embodiment, therefore, the conveyance guide 40 as a conveyance path is famed into a convex shape, and the conveyance roller 22 and tension roller 21 are arranged below the thermal head distal end portion 11*c*. Furthermore, the tension roller 21 gives tension to the printing medium 30, thereby pushing the printing medium 30 against the thermal head assembly 11. More specifically, the conveyance guide 40 is formed into a convex shape, and the apex of the projection functions as an image formation position. Consequently, a printing medium conveyed to the image formation position is also curved into a convex shape, and conveyed such that the lower surface of an image formation portion is pushed against the thermal head distal end portion 11*c*. That is, the arrangement as described above implements an arrangement which facilitates conducting heat from the thermal head assembly 11 to a printing medium without requiring any platen roller such as a conventional one.

<Stereoscopic Image Forming Operation>

The operation of stereoscopic image formation according to this embodiment will now be explained. Each printing medium 30 is fed into the apparatus from the printing medium cassette 31 by the feed roller 20 and tension roller driven by the driving motor 24. The printing medium 30 is passed through the thermal head distal end portion 11*c* and conveyed to the conveyance roller 22. Furthermore, the printing medium 30 is conveyed to the start position of a stereoscopic image to be famed. In synchronism with the timing at which the printing medium 30 is conveyed to the image formation position, a preparation operation of applying thermal energy for forming the stereoscopic image is executed, thereby starting heating the printing medium 30.

Assume that micro heating elements are arranged in the thermal head assembly 11 according to this embodiment such that the number of elements is 300 dots per inch. When the printing medium 30 coated with foaming capsules to which thermal energy must be applied for a time of about 50 msec per dot is used in this arrangement, the printing medium 30 is desirably conveyed at a constant velocity of 1.7 mm/sec or less during the application of the thermal energy because the size of one dot is about 0.085 mm.

In this state, the tension roller 21 so functions as to give a constant running load to the printing medium 30 and gives tension to the printing medium 30, so that the thermal head distal end portion 11*c* comes in tight contact with the lower surface of the printing medium in order to conduct the thermal energy from the lower surface of the printing medium to a foaming layer on the upper surface of the printing medium. More specifically, the tension roller 21 gives a weak torque in a direction opposite to the conveying direction of the printing medium 30, thereby giving a force of pulling the printing medium 30 in the direction opposite to the printing medium conveying direction. Note that the present invention is not limited to this control. For example, it is also possible to give tension to the printing medium 30 by a mechanical structure which gives a slight load with respect to the pulling of the printing medium 30 when the roller stops. As an example, the load can be applied in the conveying direction by a frictional force generated when the tension roller 21 contacts with the printing medium 30. Furthermore, the present invention is not limited to the arrangement having the printing medium conveying function such as the tension roller 21, and it is also possible to use a simple tension unit for giving tension to the printing medium. In this case, it is necessary to use an additional conveyance roller for conveying the printing medium 30 to the image formation apparatus.

When the conveyance roller 22 conveys the printing medium 30 at a constant velocity and the tension roller 21 so functions as to give the running load to the printing medium 30 at the same time, a state in which the printing medium 30 is tensed is generated, and the lower surface of the printing medium is conveyed in tight contact with the thermal head distal end portion 11*c*, because the conveyance roller 22 and tension roller 21 are arranged below the thermal head distal end portion 11*c*. As described above, this arrangement obviates the need for a platen roller for tight contact and conveyance of the printing medium 30, which is an indispensable structure of the conventional thermal printers, and can form a solid body having an arbitrary shape without interfering with the foaming phenomenon on the upper surface of the printing medium 30.

(Conveyance Roller>

Figure 3:
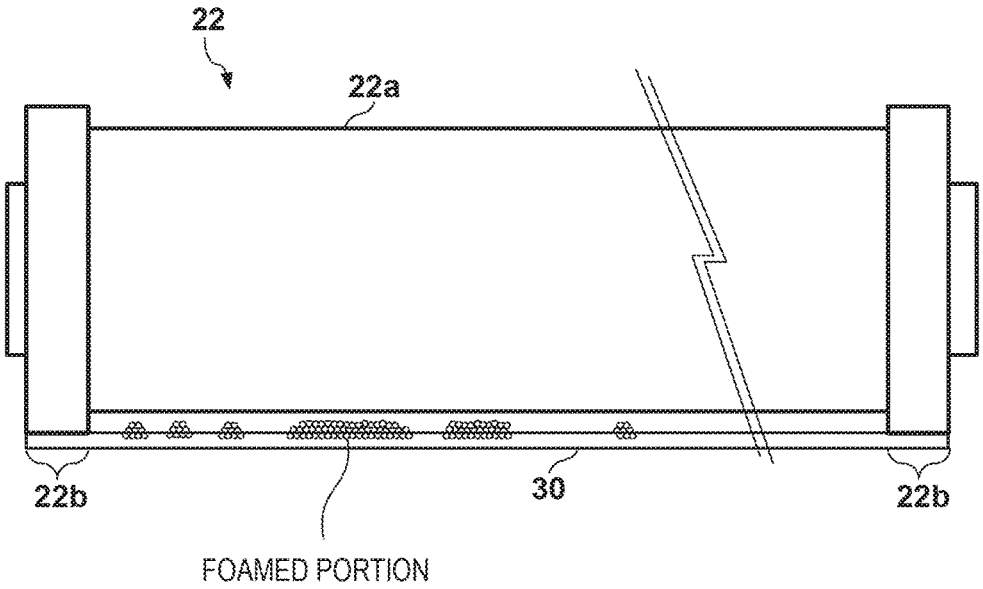
FIG. 3 is a view showing the structure of a conveyance roller according to the embodiment.

Next, a structure example of the conveyance roller 22 will be explained with reference to FIG. 3. Note that the discharge roller 23 has the same structure as that of the conveyance roller 22 to be explained below, so an explanation thereof will be omitted.

The conveyance roller 22 is positioned before the thermal head in the sub-scanning direction, that is, positioned on the downstream side of the thermal head assembly 11 in the conveying direction of the printing medium 30, and conveys the printing medium 30 at a constant velocity. That is, the conveyance roller 22 must convey the printing medium 30 on which a stereoscopic image is already famed. Therefore, the conveyance roller 22 according to this embodiment includes a main body 22*a* and grip portions 22*b*.

The main body 22*a* of a roller portion facing a stereoscopic image formable area has a diameter smaller by about 0.5 mm or more than that of the grip portions 22*b* which contact with the printing medium 30 so as not to crush foamed stereoscopic portions. Accordingly, the printing medium 30 is conveyed by the grip portions 22*b* at the two end portions of the conveyance roller. This prevents the conveyance roller 22 from crushing foamed portions heated through the thermal head. Note that instead of decreasing the diameter of the main body 22*a* of the roller portion facing the stereoscopic image formable area described above, the surface of the main body 22*a* can be formed by a soft sponge-like material. When using this sponge-like material, the area contacting the printing medium 30 increases, so the force of conveying the printing medium 30 increases.

<Printing Medium and Foaming Control>

Figure 4:
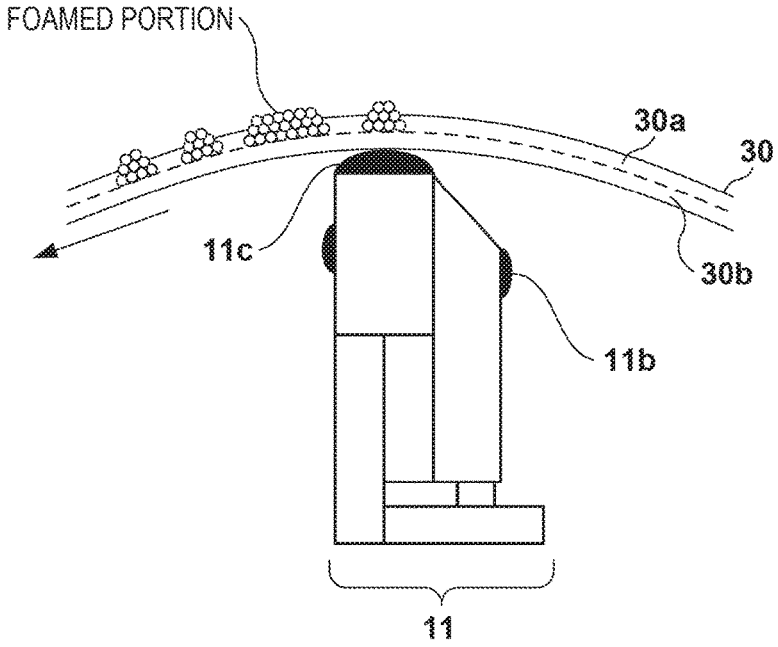
FIG. 4 is a view for explaining the details of a thermal head assembly and printing medium according to the embodiment.

The printing medium having the foaming layer according to this embodiment and foaming control of the medium will be explained below with reference to FIG. 4. FIG. 4 shows the thermal head assembly 11 and its vicinity shown in FIG. 1 in an enlarged scale, and shows the way a stereoscopic image is formed by foaming.

The printing medium 30 has a thickness of about 0.2 mm, and has a double-layered structure including a lower base layer 30*b* and a foaming layer 30*a* formed on the base layer 30*b* by coating. The foaming layer 30*a* is coated with foaming capsules which foam when heated. The thickness of the base layer 30*b* is generally about 0.1 mm. The printing medium 30 is conveyed in contact with the thermal head at an appropriate dip angle between them, so that the lower surface of the printing medium 30 runs in tight contact with the micro heating elements of the thermal head distal end portion 11*c*. Consequently, the resultant force of the pulling force of the conveyance roller 22 and the running load of the tension roller 21 functions as a force of bringing the printing medium lower surface into tight contact with the micro heating elements of the thermal head distal end portion 11*c*.

The thermal printer 100 according to this embodiment having the above arrangement can perform heating through the paper base layer 30*b* on the lower surface of the printing medium 30, and form a stereoscopic image by foaming of the foaming capsules on the printing medium upper surface. Since no member which interferes with the formation of the stereoscopic image by foaming is arranged on the printing medium upper surface, it is possible to draw an arbitrary straight line or curved line and an arbitrary area as a solid body. Also, an expected foaming height can be obtained by controlling the heating temperature and heating time in accordance with the foaming start temperature of the foaming capsules formed by coating.

<Control Configuration>

Figure 5:
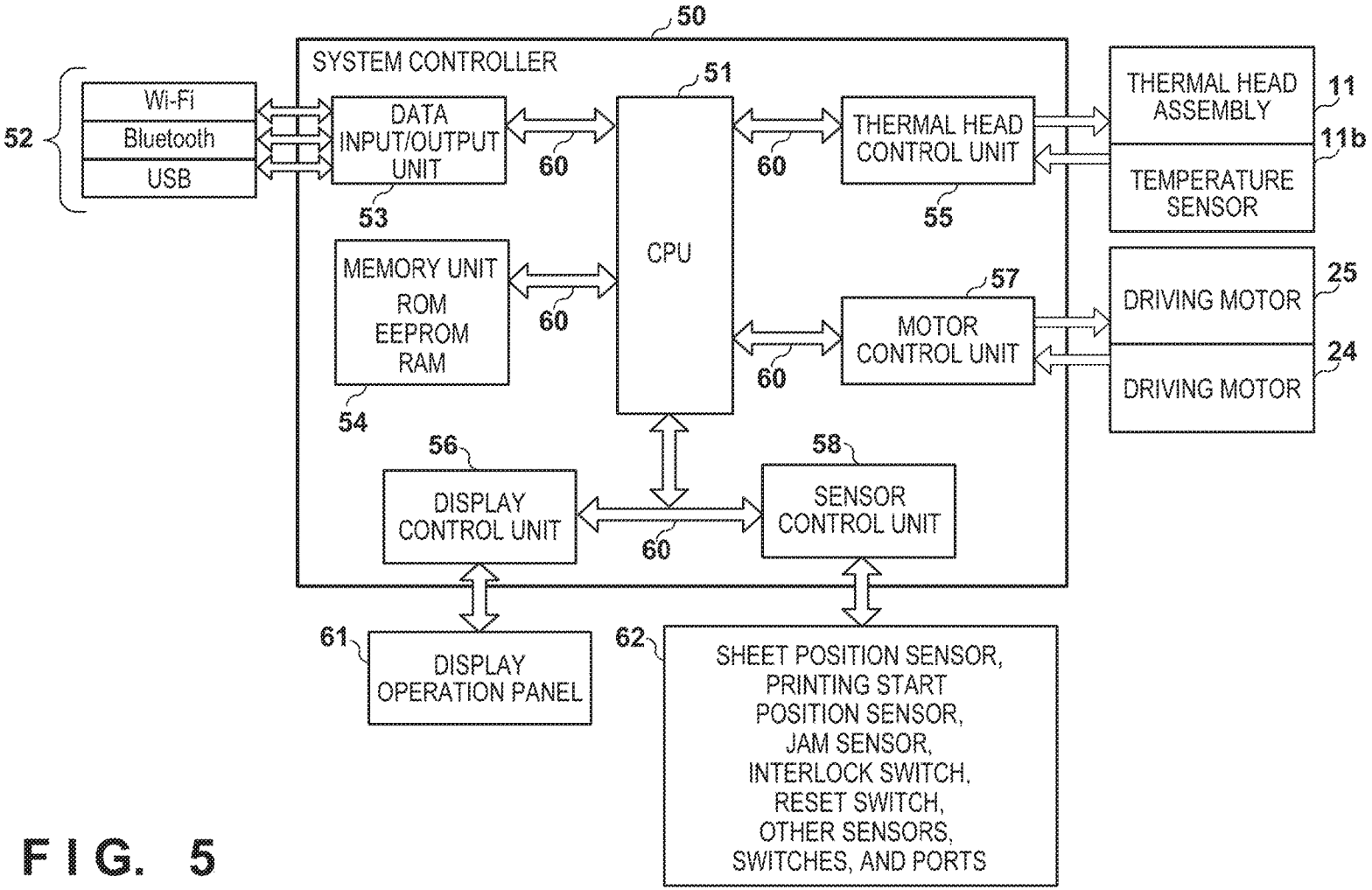
FIG. 5 is a view showing a control configuration example of the image formation apparatus according to the embodiment.

A control configuration example of the thermal printer 100 according to this embodiment will be explained below with reference to FIG. 5. The thermal printer 100 includes a system controller 50 as the control configuration. The system controller 50 includes a CPU 51, a data input/output unit 53, a memory unit 54, a thermal head control unit 55, a display control unit 56, a motor control unit 57, and a sensor control unit 58. These components are connected by bus signal lines 60 and can exchange data with each other.

The CPU 51 comprehensively controls the whole apparatus as a central processing device. The CPU 51 is connected by the bus signal lines 60 to control units having respective control functions, for example, the data input/output unit 53, memory unit 54, thermal head control unit 55, display control unit 56, motor control unit 57, and sensor control unit 58, and controls these control units to perform control operations on individual devices connected to the control units. The data input/output unit 53 is an input interface 52 such as Wi-Fi, Bluetooth®, and USB, and controls data communication with them. The memory unit 54 includes a ROM, EEPROM, and RAM, and stores control programs and various kinds of information of the thermal printer 100. The memory unit 54 also provides a work memory. The thermal head control unit 55 controls the temperature in accordance with image formation data of an image to be formed by the thermal head assembly 11, and receives the measured temperature from the temperature sensor lib. The display control unit 56 is connected to a display operation panel 61, and controls a display image on the display operation panel 61. In addition, the display control unit 56 accepts user input performed via the display image. The motor control unit 57 is connected to the driving motors 24 and 25, and controls the rotations of rollers. The sensor control unit 58 controls input/output with respect to sensors such as a sheet position sensor and image formation start position sensor, switches such as an interlock switch and reset switch, and ports indicated by reference numeral 62.

<Control Procedure>

Figure 10:
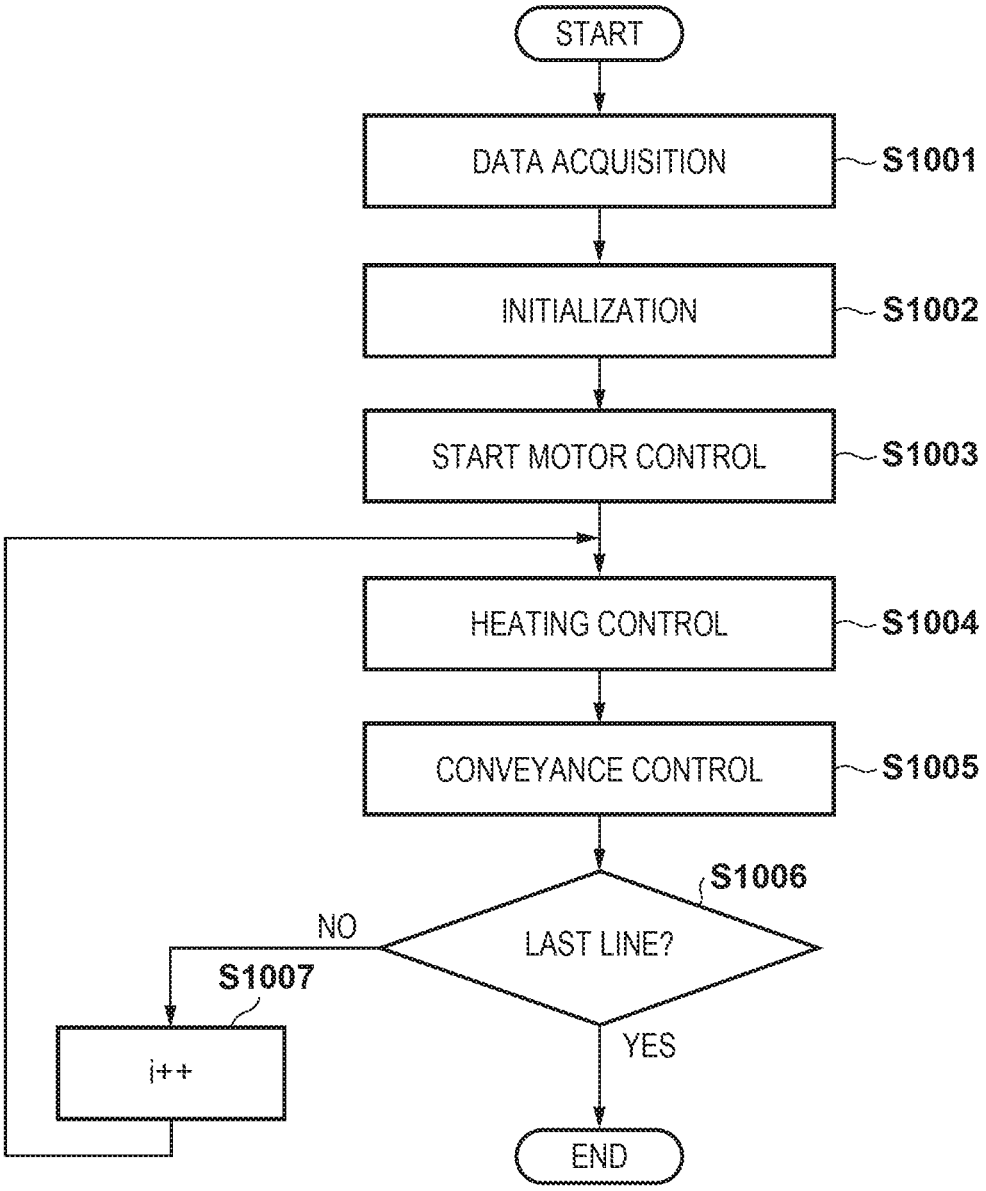
FIG. 10 is a flowchart showing the procedure of image formation according to the embodiment.

A control procedure performed when the thermal printer 100 according to this embodiment forms a stereoscopic image will be explained below with reference to FIG. 10. Note that processing to be explained below is implemented by, for example, the CPU 51 by reading out the control programs stored in the ROM and EEPROM of the memory unit 54 to the RAM, and executing the readout programs.

In step S1001, the CPU 51 controls the data input/output unit 53 to acquire image formation data of a stereoscopic image via the input interface 52 such as Wi-Fi, Bluetooth, or USB. The CPU 51 stores the acquired image formation data in the RAM as a programmable memory of the memory unit 54. Note that if the transmitted image formation data is character format data such as a text, it is desirable to convert the data into image format data and use the converted data.

Then, in step S1002, the CPU 51 initializes various parameters. For example, the image formation data is processed line by line in the main scanning direction in this image formation, so the CPU 51 initializes a variable indicating a processing target line. Subsequently, in step S1003, the CPU 51 controls the motor control unit 57 to start driving the driving motors 24 and 25, thereby pulling out the printing media 30 one by one from the printing medium cassette 31, and conveying the printing medium 30 fed into the apparatus to the image formation start position.

After that, in step S1004, the CPU 51 controls the thermal head control unit 55 to start an operation of heating predetermined portions of the thermal head in accordance with the image to be formed, in synchronism with the arrival of the printing medium 30 at the image formation start position. In this step, the thermal head control unit 55 processes the image formation data stored in the RAM of the memory unit 54 line by line in the main scanning direction of the thermal head, in accordance with a variable i indicating the above-mentioned processing target line. Also, the thermal head control unit 55 calculates a heating time corresponding to the pixel line widths, line intervals, solid portion areas, and the like in the image formation data to be formed, and heats thermal head portions corresponding to the individual pixels of the image. In addition, the thermal head control unit 55 controls heating by correcting the heating time in accordance with the heater block heat storage status (sensing result) sensed by the temperature sensor lib attached to the thermal head. This makes it possible to suitably perform heating control, and shorten the output time.

Figure 6:
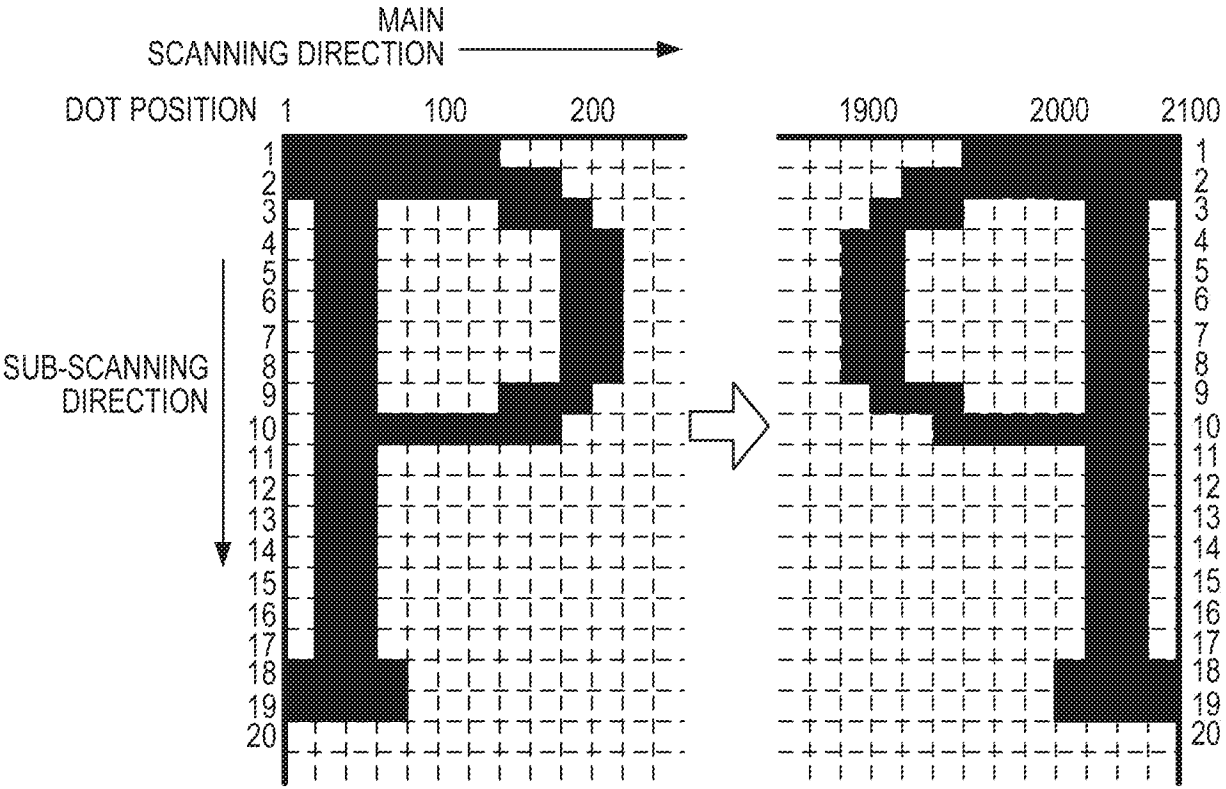
FIG. 6 is a view for explaining image inversion according to the embodiment.

In this state, the image data must be an inverted image as shown in FIG. 6 in order to form a solid body on the upper surface of the printing medium by heating from the lower surface thereof. In this example shown in FIG. 6, an image formable range in the main scanning direction of the thermal head extends from the first dot to the 2,100th dot. In this case, if an image of a character "P" is to be famed as a solid body from the first dot on the first line as a start point, the whole image on the first line is horizontally inverted, and the start point of the character "P" is processed as the 2,100th dot on the first line.

Then, in step S1005, the CPU 51 controls the motor control unit 57 to control the driving of the driving motors 24 and 25, thereby controlling the conveyance of the printing medium 30. More specifically, the CPU 51 performs control so as to give tension to the printing medium 30 while the thermal head assembly 11 is applying heat to predetermined portions of the printing medium 30 conveyed to the image formation position in step S1003. As described earlier, to give tension to the printing medium 30, the motor control unit 57 controls the driving motor 24 to give a relatively weak torque to the tension roller 21 so as to pull the printing medium 30 in the direction opposite to the conveying direction of the printing medium 30. After the thermal head assembly 11 applies heat during the time required to form a stereoscopic image corresponding to the image formation data on one line in the main scanning direction, the motor control unit 57 controls the driving motors 24 and 25 to convey the printing medium 30 by one line. Thus, the printing medium 30 is conveyed line by line in the sub-scanning direction of the thermal head, and that portion of the thermal head which corresponds to the part of the image is heated for each line, thereby forming a stereoscopic image by the applied heat.

In step S1006, the CPU 51 determines whether image formation in the sub-scanning direction is complete. If image formation is complete, the CPU 51 terminates the process. If not, the process advances to step S1007, and the CPU 51 sets the next line as a processing target line (a variable i++), and returns the process to step S1004.

<Foaming Height>

Figure 7:
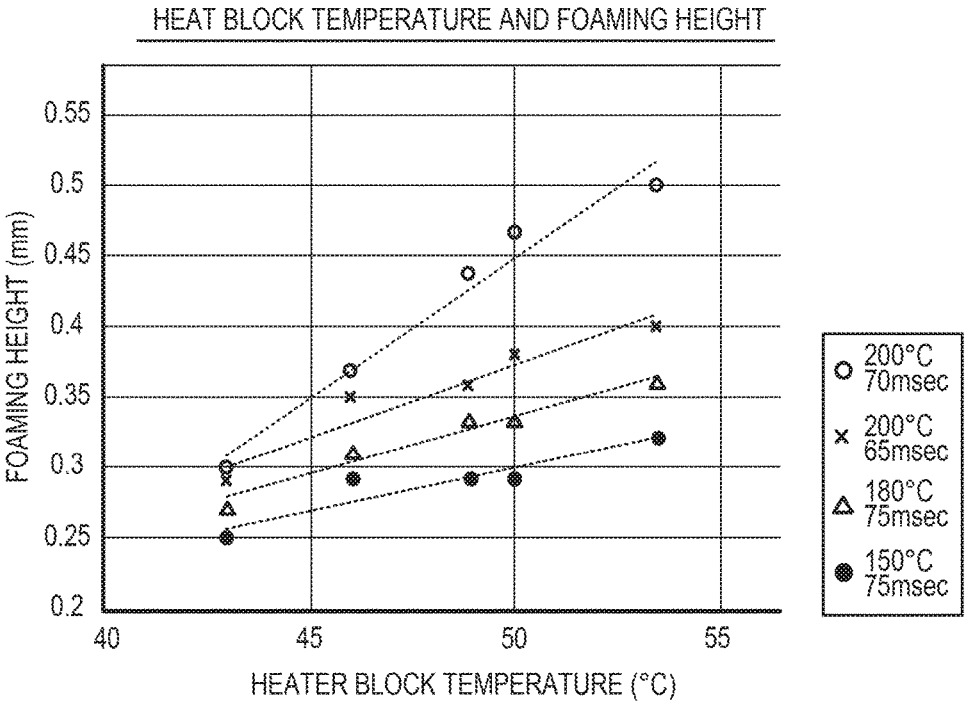
FIG. 7 is a view showing the correlation between the heater block temperature and the height of foaming according to the embodiment.
Figure 8:
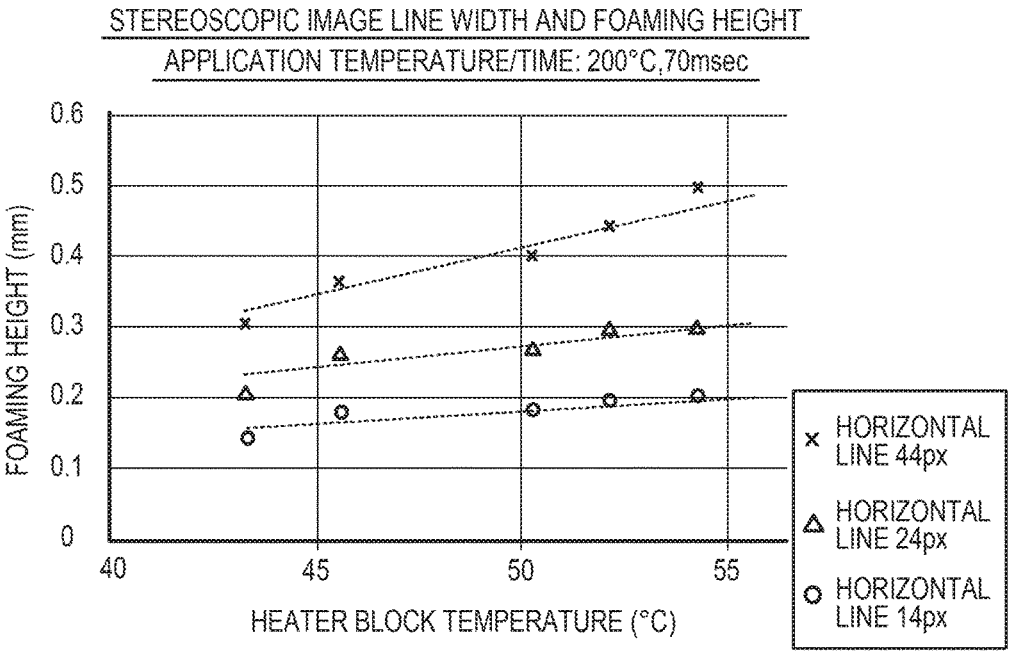
FIG. 8 is a view showing the correlation between the line width of a stereoscopic image and the height of foaming according to the embodiment.
Figure 9:
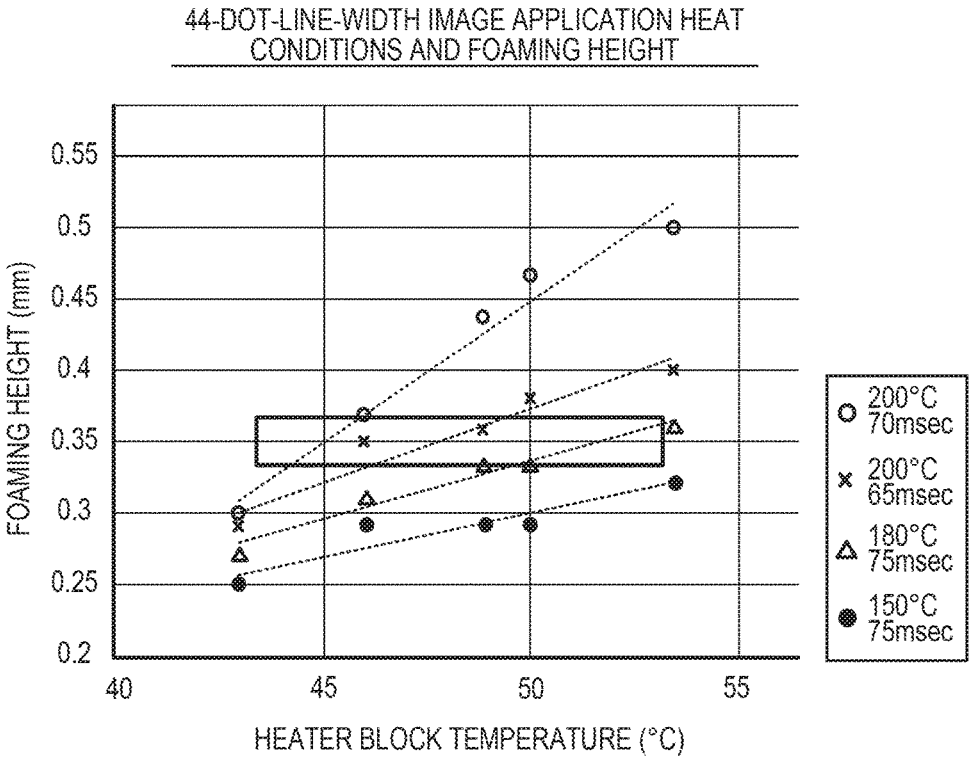
FIG. 9 is a view showing the correlation between the application heat conditions of a 44-dot-line-width image and the height of foaming according to the embodiment.

The status of foaming resulting from heating control according to this embodiment will be explained below with reference to FIGS. 7, 8, and 9. FIG. 7 is a correlation diagram of the heater block temperature and the height of foaming, FIG. 8 is a correlation diagram of the line width of a stereoscopic image and the height of foaming, and FIG. 9 is a correlation diagram of the application heat conditions of a 44-dot-line-width image and the height of foaming. The explanation will be made based on the following conditions. That is, the printing medium thickness is 0.2 mm, the foaming capsule layer is 0.1 mm, the foaming start temperature is about 140° C., the specifications of the thermal head are 300 DPI and 24 V, the heating element resistance value is about 2 KΩ, and the printing medium conveying velocity is 1 mm/sec. Based on the conditions, thermal energy application control for foaming a stereoscopic image according to this embodiment will be explained.

FIG. 7 is the correlation diagram of the heater block temperature and the height of foaming. The abscissa indicates the heater block temperature, and the ordinate indicates the foaming height. This example of FIG. 7 shows the status (temperature rise) of heat storage in the heater block of the thermal head and the change in foaming height, for each temperature/time condition of application thermal energy, when forming a stereoscopic image of a 44-dot-line-width straight line. FIG. 7 demonstrates that heat storage in the heater block progresses with the elapse of the printing process time, and the foaming height increases in accordance with this temperature rise, regardless of the application thermal energy conditions.

FIG. 8 is the correlation diagram of the line width of a stereoscopic image and the height of foaming. The abscissa indicates the heater block temperature, and the ordinate indicates the foaming height. Like FIG. 7, FIG. 8 reveals that the foaming height increases based on the heat storage state of the heater block, and the foaming height changes in accordance with the line width of a stereoscopic image if the application thermal energy is constant. FIG. 8 shows a case in which the application thermal energy conditions are fixed to 200° C. and 70 msec, and straight lines having different line widths (44 px, 24 px, and 14 px) are formed as solid bodies. However, the foaming height of a thick straight line having a line width of 44 pixels (pixel, px) is larger than the foaming heights of straight lines having other line widths. This is so because as the number of adjacent micro heating elements to be driven in the thermal head increases, the thermal energy is conducted to the foaming capsules contained in the foaming layer 30*a* of the printing medium 30 more easily. On the other hand, when the number of adjacent micro heating elements to be driven in the thermal head is small, the application thermal energy easily escapes to the heater block side, so heat storage in the heater block progresses, but the thermal energy required for foaming is not conducted to the foaming capsules. That is, FIG. 8 shows that in order to hold the foaming height constant, the amount of necessary heating energy changes in accordance with the line width of a stereoscopic image.

FIG. 9 is the correlation diagram of the application thermal energy conditions of a 44-dot-line-width image and the height of foaming. The abscissa indicates the heater block temperature, and the ordinate indicates the foaming height. FIG. 9 shows that the foaming height changes in accordance with the heat storage state of the heater block, for the individual application thermal energy conditions (the temperature and time). As an example, a range within which the foaming height is 0.35 mm, that is, a quadrilateral portion in FIG. 9 will be explained. This portion reveals that the application thermal energy conditions for obtaining a foaming height of 0.35 mm change in accordance with the status of the heat storage temperature of the heater block.

As has been explained above, the thermal printer 100 according to this embodiment forms a stereoscopic image by applying heat to the printing medium 30 having the surface evenly coated with the foaming capsules which foam when heated. More specifically, the thermal printer 100 includes the feed roller 20, tension roller 21, conveyance roller 22, and discharge roller 23 for feeding the printing medium 30 into the apparatus and conveying the printing medium 30, the conveyance guide 40 which is formed into a convex shape whose apex is the image formation position where heat is applied to the printing medium 30, and regulates the position of the conveyed printing medium 30, the thermal head assembly 11 which is installed such that the thermal head distal end portion 11*c* contacts with the printing medium 30 conveyed by the conveyance roller 22 from below the image formation position, and forms a stereoscopic image by applying heat to the printing medium 30, and the tension roller 21 which is installed on the upstream side of the image formation position in the conveying direction of the printing medium 30, and pushes the conveyed printing medium 30 toward the thermal head distal end portion 11*c* by giving tension to the printing medium 30. In this arrangement, the thermal printer 100 applies thermal energy from the lower surface of the printing medium 30 coated with the foaming capsules, thereby foaming a continuous straight line or curved line or an arbitrary area as a solid body. More specifically, the thermal printer 100 controls the thermal energy for stereoscopic image formation by using information such as the line width and continuity of a stereoscopic image to be formed, the line widths of nearby stereoscopic images, and the distance between the nearby images. In addition, the thermal printer 11 measures the heat storage state of the thermal head by the temperature sensor lib, and corrects and controls the above-described application thermal energy by using the measured value. This makes it possible to form a stereoscopic image by foaming having an intended height.

Also, this embodiment uses the thermal head technique used in an ordinary thermal head printer. Accordingly, the main constituent elements of the apparatus are the thermal head for applying the thermal energy, the conveyance roller mechanisms for conveying the printing medium 30, the setting unit and discharge unit for the printing medium 30, and the control units for controlling the thermal head and rollers. Consequently, a small-sized, low-noise, and inexpensive apparatus can be provided.

Furthermore, the thermal printer 100 is a mechanism which does not include any platen roller, and causes the conveyance roller mechanisms (the tension roller 21 and conveyance roller 22) arranged before and after the thermal head to convey the printing medium 30 in tight contact with the thermal head. Since, therefore, the conventional thermal printer platen mechanism which interferes with the formation of a stereoscopic image by foaming is not used, it is possible to form a dot, a straight line, a curved line, and an arbitrary area as solid bodies.

Also, in the system which conducts the thermal energy to the foaming capsules through the paper thickness from the lower surface of the printing medium 30, heating must be continued for 50 to 80 msec per dot for the printing medium 30 having a paper thickness of, for example, 0.2 mm, so the thermal head itself stores heat. In this embodiment, therefore, this heat storage state is measured by the temperature sensor lib attached to the thermal head and used in control. More specifically, the thermal printer 100 uses, as control elements, the measured value of the heat storage state, and image-related information such as the line width and continuity of a stereoscopic image to be formed, the line widths of nearby stereoscopic images, and the distance between the images, and performs control such that the famed stereoscopic image has the intended height. In addition, if the heat storage state of the thermal head increases, control is so performed as to reduce the thermal energy generated by the micro heating elements of the thermal head. This makes it possible to prevent destruction caused by extreme heat storage by the thermal head, and reduce the power consumption.

Second Embodiment

Figure 2:
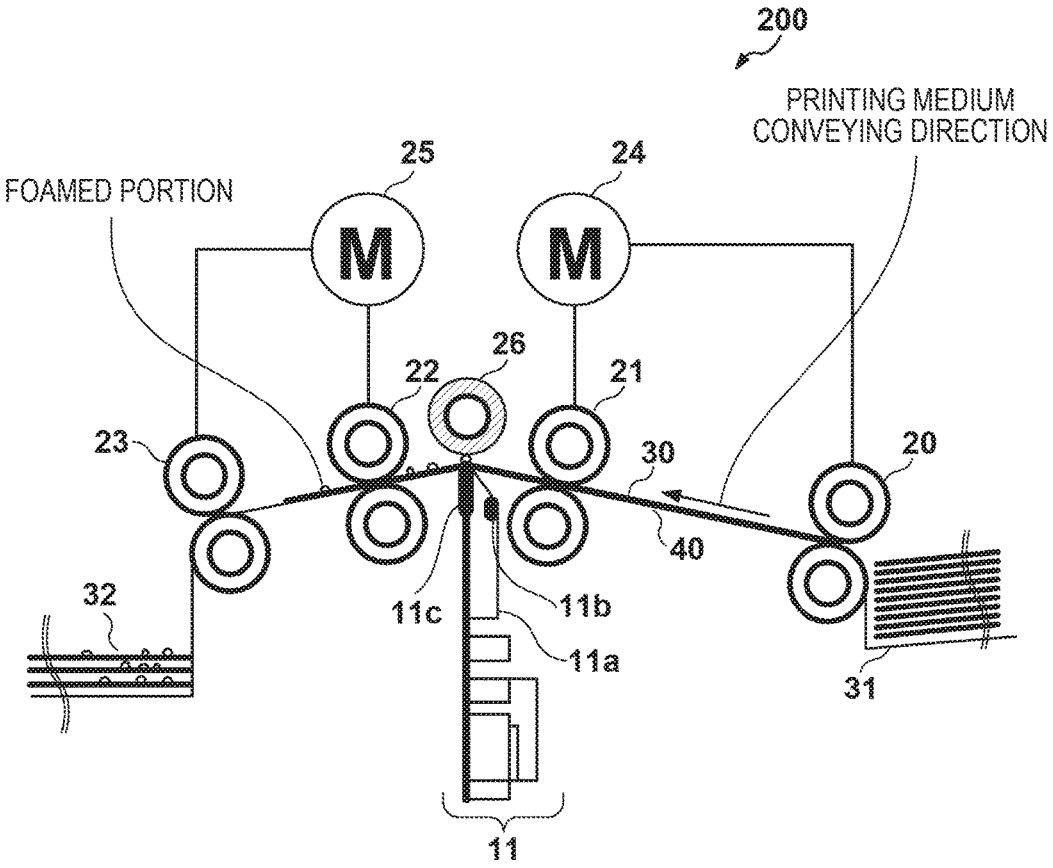
FIG. 2 is a view showing an arrangement example of an image formation apparatus according to another embodiment.

The second embodiment of the present invention will be explained below with reference to FIG. 2. FIG. 2 shows an arrangement example of a thermal printer 200 according to this embodiment. In the second embodiment, a component and control different from the first embodiment will be explained. Note that the same reference numerals as in the first embodiment denote the same components, and an explanation thereof will be omitted.

As shown in FIG. 2, the thermal printer 200 according to this embodiment includes a soft sponge-like support roller 26. The support roller 26 is placed in the same position as that of a platen roller used in a conventional thermal printer, that is, in a position facing a thermal head assembly 11.

An operation of forming a stereoscopic image by the thermal printer 200 according to this embodiment will be explained. Control different from the abovementioned first embodiment is the control of a tension roller 21. After a thermal energy applying operation is started, a thermal head distal end portion 11*c* must always be in tight contact with the printing medium lower surface in order to conduct the thermal energy from the printing medium lower surface to a foaming layer 30*a* on the printing medium upper surface. In this embodiment, however, unlike the abovementioned first embodiment, the tension roller 21 need not function to give tension to the printing medium 30 after having transferred the printing medium 30 to a conveyance roller 22. That is, control such as reverse rotation need not be performed.

Instead, this embodiment includes the support roller 26 so that the printing medium lower surface comes into tight contact with the thermal head distal end portion 11*c*. Since the support roller 26 is made of a soft sponge-like material, the support roller 26 has a small micro-area pushing force and hence does not interfere with the foaming phenomenon. However, the support roller 26 can press a whole portion of the printing medium 30, which faces the thermal head distal end portion 11*c*. Even when there is no tension function of the tension roller 21, therefore, it is possible to maintain the tight contact between the printing medium 30 and the thermal head distal end portion 11*c*. Note that the present invention is not limited to this, and that portion of the support roller 26, which contacts with the printing medium 30, need only be formed by a soft material which does not crush the foaming portion, so the material is not limited to sponge.

As has been explained above, the thermal printer 200 according to this embodiment uses the support roller 26 formed by a soft material having a relatively low pushing force, instead of the conventional platen roller, and pushes the printing medium 30 against the thermal head distal end portion 11*c* by this support roller. As a consequence, the same effects as those of the aforementioned first embodiment can be obtained. Note that in this embodiment, a conveyance guide 40 as a conveyance path need not be famed into a convex shape because the printing medium 30 is pushed by the support roller 26.

The present invention can provide a small-sized, low-noise, and inexpensive image formation apparatus capable of foaming a stereoscopic image of an arbitrary continuous straight line or curved line by using a thermal head, and provide a control method and program of the apparatus.

This application claims the benefit of Japanese Patent Application No. 2016-203022 filed on Oct. 14, 2016, which is hereby incorporated by reference herein in its entirety.

What is claimed is:

1. An image formation apparatus for forming a stereoscopic image by applying heat to a printing medium having a surface evenly coated with foaming capsules which foam when heated, comprising:

a plurality of conveyance rollers that feed the printing medium into the apparatus and convey the printing medium;

a conveyance guide that is formed into a convex shape whose apex is an image formation position where heat is applied to the printing medium, and regulates a position of the conveyed printing medium;

a thermal head that is installed such that a distal end portion contacts with a printing medium conveyed by the plurality of conveyance rollers from below the image formation position, and forms a stereoscopic image by applying heat to the printing medium; and a tension unit that is positioned on an upstream side of the image formation position in a conveying direction of a printing medium, and pushes the conveyed printing medium toward the distal end portion of the thermal head by giving tension to the printing medium.

2. The apparatus according to claim 1, further comprising a control unit that controls the tension unit to contact with and give load to the printing medium, when the printing medium is conveyed to the image formation position by the plurality of conveyance rollers.

3. The apparatus according to claim 2, wherein the tension unit is a tension roller that conveys the printing medium to the image formation position, and when the printing medium is conveyed to the image formation position by the plurality of conveyance rollers, the control unit performs control to give torque to the tension roller such that the printing medium is pulled in a direction opposite to the conveying direction.

4. The apparatus according to claim 3, wherein the tension roller is positioned below a distal end portion of the thermal head.

5. The apparatus according to claim 1, further comprising a support roller that is placed in a position facing a distal end portion of the thermal head and contacts with the conveyed printing medium and pushes the printing medium toward the distal end portion of the thermal head, a portion of the support roller which contacts with the printing medium being formed by a material which does not crush a foaming portion of the printing medium.

6. The apparatus according to claim 5, wherein the material is sponge.

7. The apparatus according to claim 2, wherein in synchronism with a timing at which the printing medium is conveyed to the image formation position, the control unit calculates a heating time corresponding to a foaming height of each pixel in image formation data to be famed, and performs heating control on a plurality of micro heating elements formed in the thermal head in accordance with the calculated heating time.

8. The apparatus according to claim 7, wherein the control unit fans an image by performing heating control on the plurality of micro heating elements for each line in a main scanning direction.

9. The apparatus according to claim 7, further comprising a plurality of temperature sensors that sense heat storage states of the plurality of micro heating elements of the thermal head, wherein the control unit corrects a heating control time corresponding to the image formation data based on sensing results from the plurality of temperature sensors.

10. The apparatus according to claim 1, wherein the conveyance roller of the plurality of conveyance rollers, which is positioned on a downstream side of the image formation position in the conveying direction, conveys the printing medium by contacting with two end portions of the printing medium in a sub-scanning direction without contacting with a foamed portion where an image is formed.

* * * * *